US008262303B2

(12) United States Patent
Burnett

(10) Patent No.: US 8,262,303 B2
(45) Date of Patent: Sep. 11, 2012

(54) PRE-DESIGNED FACE PAINTING SYSTEM

(76) Inventor: Nicholas Burnett, Westfield, NJ (US)

( * ) Notice: Subject to any disclaimer, the term of this patent is extended or adjusted under 35 U.S.C. 154(b) by 552 days.

(21) Appl. No.: 12/473,867

(22) Filed: May 28, 2009

(65) Prior Publication Data

US 2010/0300478 A1 Dec. 2, 2010

(51) Int. Cl.
*A46B 5/02* (2006.01)

(52) U.S. Cl. ..... 401/6; 428/354; 428/914

(58) Field of Classification Search ..... 401/6, 192; 132/285, 319; 428/41.6, 41.8, 354, 914
See application file for complete search history.

(56) References Cited

U.S. PATENT DOCUMENTS 4,117,837 A * 10/1978 Masso Remiro ..... 606/204.35
5,706,828 A * 1/1998 Shiota ..... 128/857
5,816,269 A 10/1998 Mohammed
5,942,065 A 8/1999 Biggs et al.
5,958,560 A 9/1999 Ewan
6,177,482 B1 1/2001 Cinelli et al.
D479,731 S 9/2003 Morrow et al.
2003/0187518 A1 10/2003 Carls

* cited by examiner

*Primary Examiner* — Tuan N Nguyen
(74) *Attorney, Agent, or Firm* — Kyle Fletcher

(57) ABSTRACT

The pre-designed face-painting system consists of a protective mask, the pre-designed face painting, and a transparent film. The pre-designed face painting comprises a layer of ink that is mixed with an adhesive to apply the design to the face upon the application of pressure from the protective mask. The system requires removal of the transparent film, alignment of the mask, pressing the face painting onto the face, and removal of the protective mask. The face painting is easily removed after rinsing the face with soap and water.

8 Claims, 5 Drawing Sheets

PRE-DESIGNED FACE PAINTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of face painting, more specifically, a pre-designed face painting system that simply stick onto the surface of the face without the requirement of an artist' hand to manually draw said design on the face.

B. Discussion of the Prior Art

As a preliminary note, it should be stated that there is an ample amount of prior art that deals with face painting. As will be discussed immediately below, no prior art discloses a pre-designed face painting system that comprises the steps of removing a transparent film, aligning and pressing the pre-designed face painting onto the face, and removal of the protective mask. The pre-designed face painting simply adheres to the face in order to resemble face painting without the hassle of manually applying said design onto the face.

The Ewan Patent (U.S. Pat. No. 5,958,560) discloses a temporary tattoo in which the paper stock and design being overlaid by an adhesive and release coating for application to the skin of the user. However, the temporary tattoo relies upon layers of backing material in addition to other layers as opposed to a face painting that simply adheres to the surface of the skin upon application of pressure from a protective mask and of which arrives pre-packaged and sandwiched between a transparent film and said mask.

The Carls Patent Application Publication (U.S. Publication No. 2003/0187518) discloses a self-adhesive prosthetic make-up. However, the self-adhesive prosthetic does not involve a decal or logo as a pre-designed image that adheres to the surface of the skin.

The Mohammed Patent (U.S. Pat. No. 5,816,269) discloses a temporary tattoo that can be formed on a person's skin, using a stencil mechanism that has flexibility and adhesive attachment to the skin surface. However, the flexible stencil sheet is sandwiched between a backing sheet and protective carrier sheet and is not simply a pre-designed face painting that adheres to the surface of the skin and arrives pre-packaged between a removable transparent film and mask backing that is also removed upon application of the face painting to the face.

The Cinelli et al. Patent (U.S. Pat. No. 6,177,482) discloses an adhesive for secure topical attachment to the skin. However, the disclosure is directed to only an adhesive and not a pre-designed face painting system that is applied to the face and of which arrives pre-packaged between a transparent film and mask that is used to apply the design to the face.

The Biggs et al. Patent (U.S. Pat. No. 5,942,065) discloses a skin adhesive decal. However, the sticker relies upon a paper backing and an ink-accepting paper as opposed to a pre-designed face painting system that adheres to the surface of the skin and arrives pre-packaged between a transparent film and mask.

While the above-described devices fulfill their respective and particular objects and requirements, they do not describe a pre-designed face painting system that comprises the steps of removing a transparent film, aligning and pressing the pre-designed face painting onto the face, and removal of the protective mask. In this regard, the pre-designed face-painting system departs from the conventional concepts and designs of the prior art.

BRIEF SUMMARY OF THE INVENTION

The pre-designed face-painting system consists of a protective mask, the pre-designed face painting, and a transparent film. The pre-designed face painting comprises a layer of ink that is mixed with an adhesive to apply the design to the face upon the application of pressure from the protective mask. The system requires removal of the transparent film, alignment of the mask, pressing the face painting onto the face, and removal of the protective mask. The face painting is easily removed after rinsing the face with soap and water.

An object of the invention is to provide a pre-designed face painting system that easily applies the face painting to the skin.

A further object of the invention is to provide a face-painting system that can involve different designs encompassing sporting logos and decals.

A further object of the invention is to provide a face-painting system that arrives sandwiched between a protective mask and a transparent film, wherein the protective mask protects as wells as assists in the application of the face painting design to a face.

These together with additional objects, features and advantages of the pre-designed face-painting system will be readily apparent to those of ordinary skill in the art upon reading the following detailed description of presently preferred, but nonetheless illustrative, embodiments of the pre-designed pre-designed face-painting system when taken in conjunction with the accompanying drawings.

In this respect, before explaining the current embodiments of the pre-designed face-painting system in detail, it is to be understood that the pre-designed face-painting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pre-designed face-painting system. It is therefore important that the claims be regarded as including such equivalent construction insofar as they do not depart from the spirit and scope of the pre-designed face-painting system.

It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
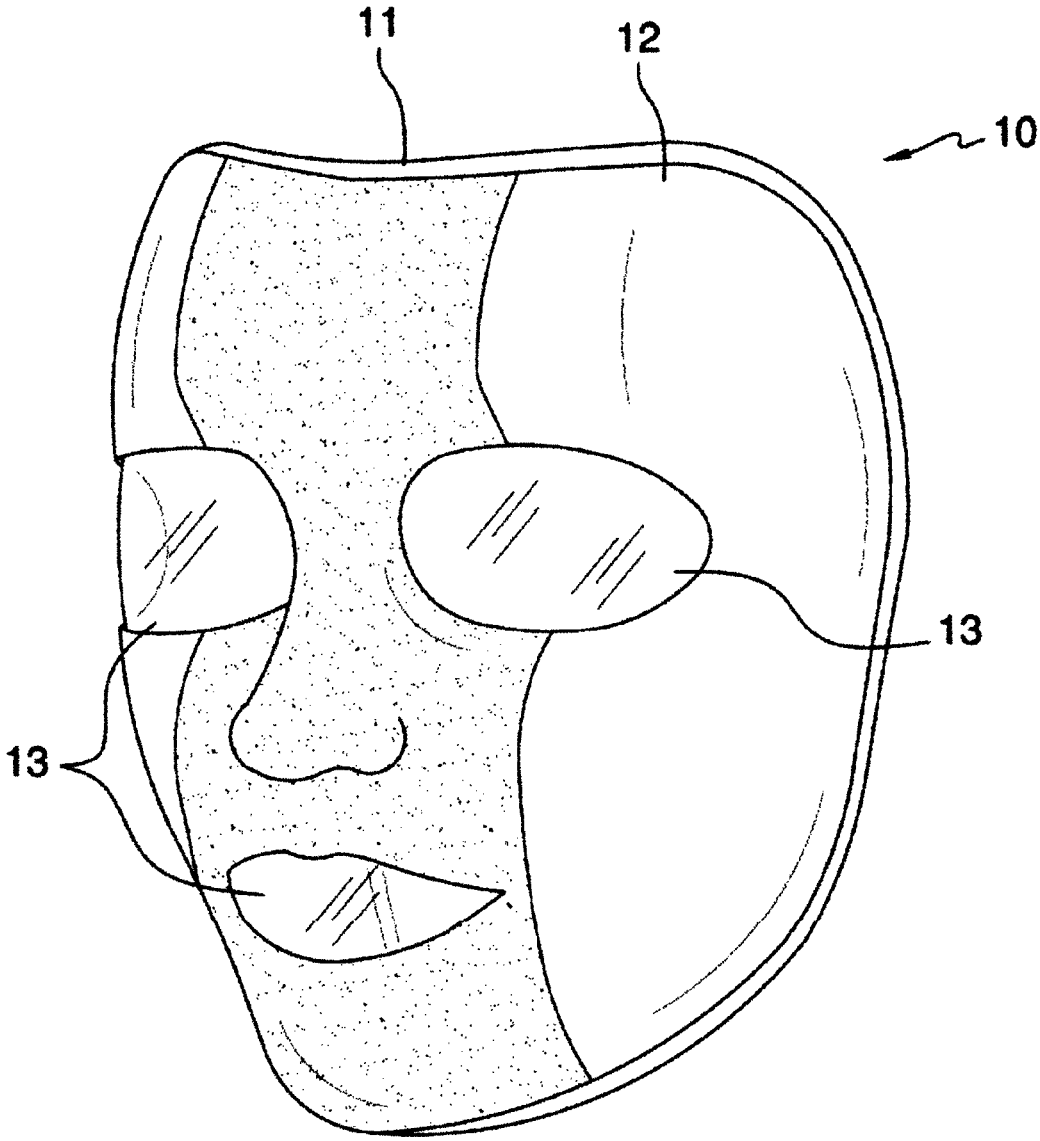
FIG. 1 illustrates a front, isometric view of the pre-designed face-painting system including the protective mask and transparent film.
Figure 2:
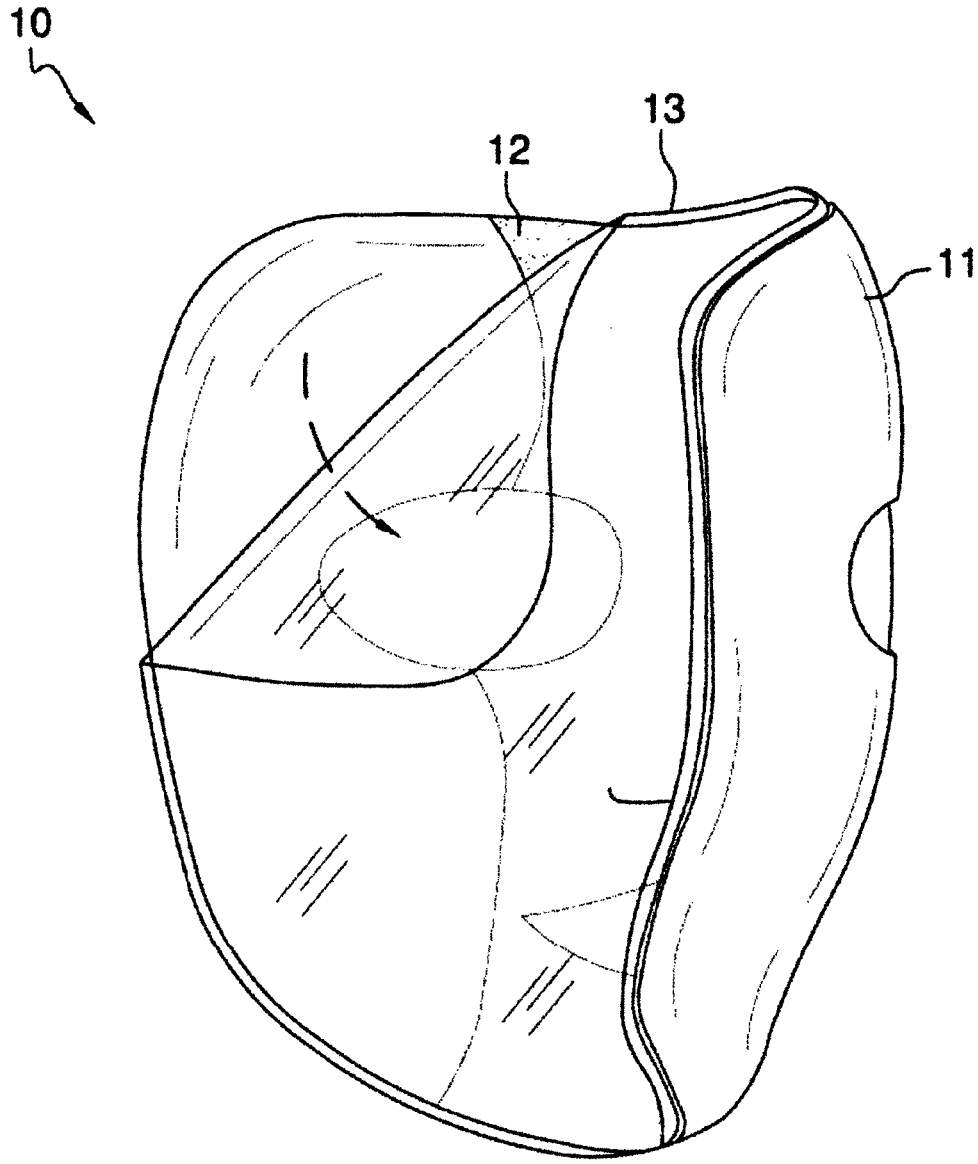
FIG. 2 illustrates a rear, isometric view of the pre-designed face-painting system with a part of the transparent film peeled away from the face painting in anticipation of application of the face painting onto a face.
Figure 3:
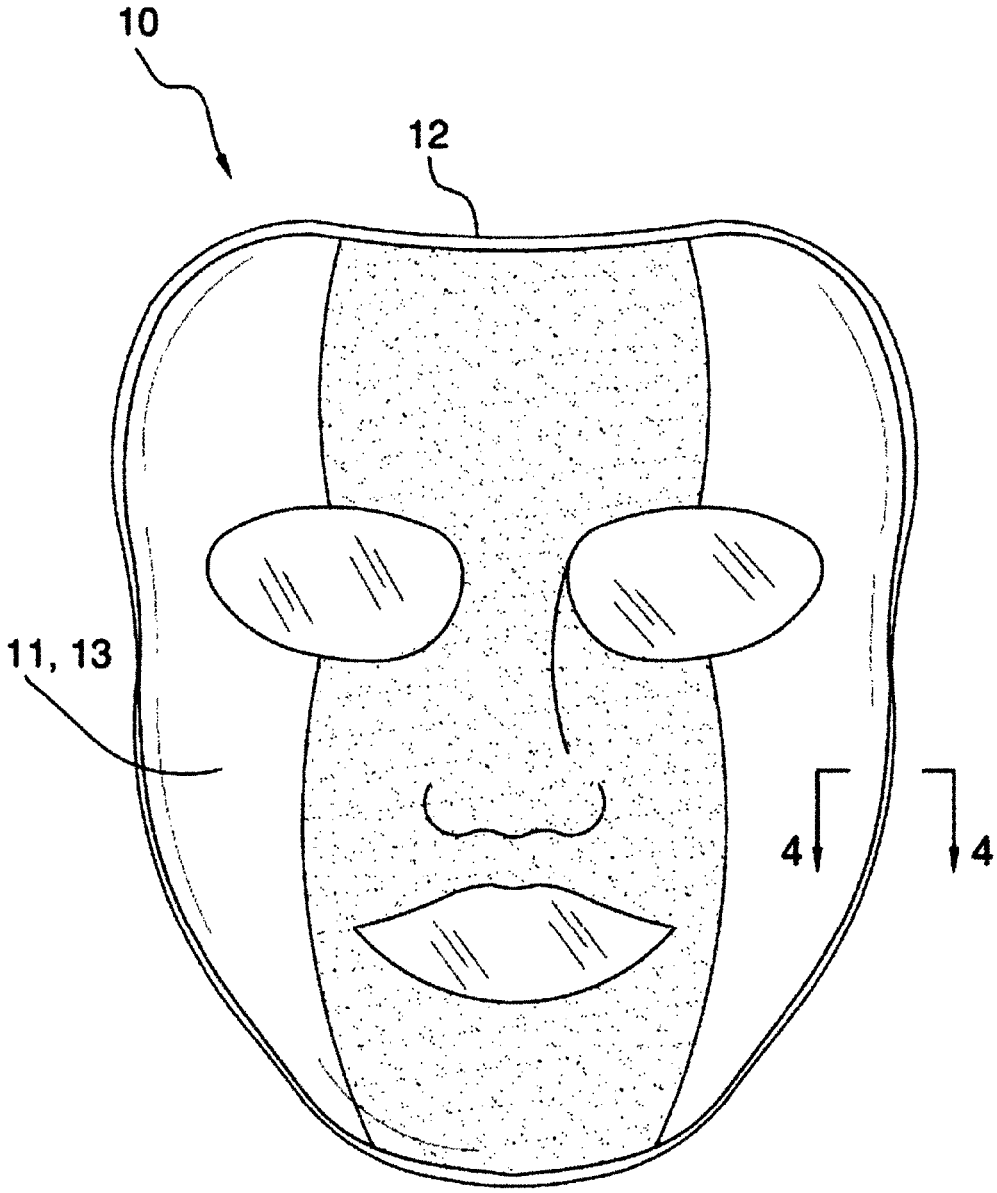
FIG. 3 illustrates a front view of the pre-designed face-painting system with the protective mask covering the face painting.
Figure 4:
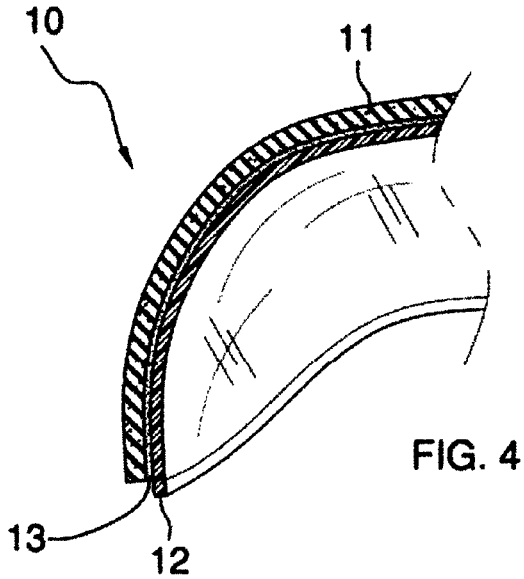
FIG. 4 illustrates a cross-sectional view of the pre-designed face-painting system along line 4-4, and detailing the protective mask, face painting, and transparent film.
Figure 5A:
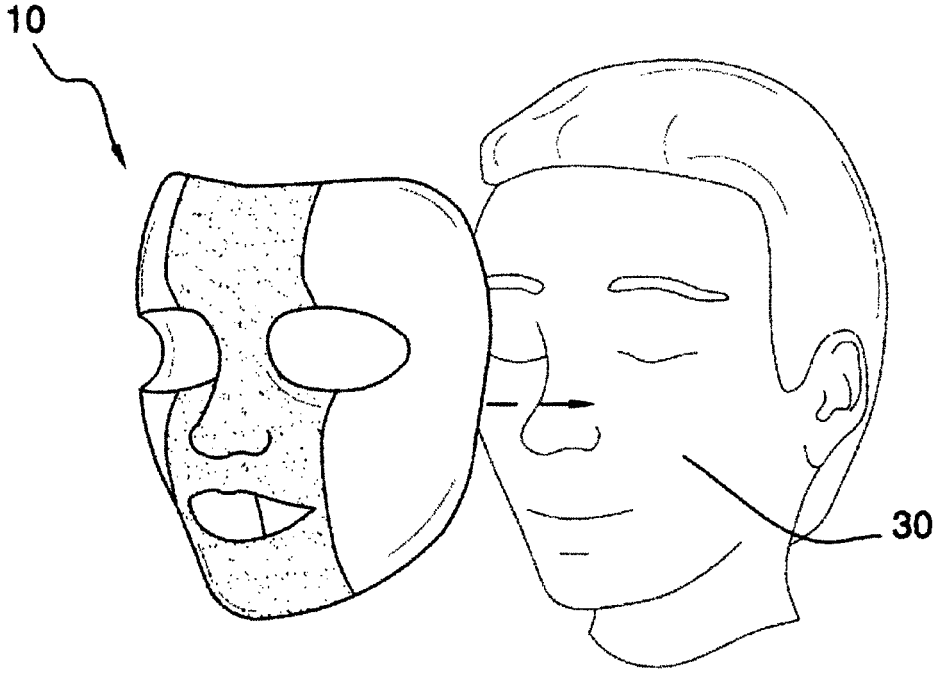
FIG. 5A illustrates the pre-designed face-painting system with the transparent film removed, and the face painting being applied to a face.
Figure 5B:
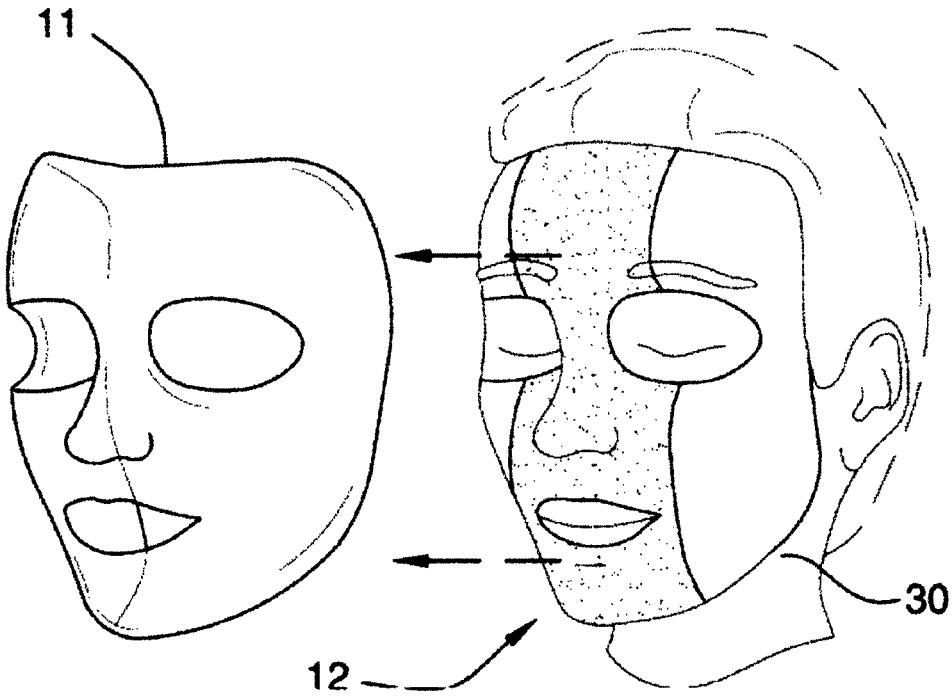
FIG. 5B illustrates the protective mask being removed from the face painting, and wherein the face painting has been applied to the face.

Detailed reference will now be made to the preferred embodiment of the present invention, examples of which are illustrated in FIGS. 1-5B. A pre-designed face-painting system 10 (hereinafter invention) is comprised of a protective mask 11, a pre-designed face painting 12, and transparent film 13.

The pre-designed face painting 12 is composed of a paint that is either mixed with an adhesive or has adhesive qualities inherently that enable the paint to adhere to the surface of skin. The paint and/or adhesive used in the pre-designed face painting 12 are non-toxic, breathable, and are easily washed off of skin by soap and warm water. Also, the layout of the pre-designed face painting 12 resembles that of a mask and includes openings to accommodate, the nose, mouth, and eyes of an end user.

Also, the pre-designed face painting 12 comes in a pre-designed layout to resemble a plurality of functions associated with sports-related decals, music band-related decals, comic-book hero faces, Halloween based faces, pictures, camouflage, colors, crests, etc.

The transparent film 13 is designed to attach to an outer edge of the protective mask 11, and is also made of a material that does not disturb or react with the pre-designed face painting 12. The transparent film 13 is made of a material comprising a plastic, fabric, waxed paper, or paper.

The protective mask 11 supports the pre-designed face painting 12, and is made of a material that resists absorbing or interacting chemically with the pre-designed face painting 12. The protective mask 12 is made of a plastic.

The invention 10 arrives pre-packaged and is applied by first removing the transparent film 13. Next, the protective mask 11 is aligned with a face 30. Next, a small amount of pressure is applied to the protective mask 11 in order to adhere the pre-designed face painting 12 to said face 30. Next, the protective mask 11 is gently removed, leaving the pre-designed face painting 12 applied to said face 30.

The invention 10 may be adapted for other geometric shapes for placement on other areas of the body.

Variations and alternatives of the present embodiment including equivalent structures and structural equivalents are readily apparent to those of ordinary skill in the art upon reading the present disclosure, and such variations and alternatives are incorporated in the invention unless otherwise expressly indicated in the claims.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

The invention claimed is:

1. A face-painting system comprising:

a face painting, which is a layer that resembles a mask placed over an existing face, and which includes openings thereon to accommodate the nose, mouth, and eyes of said existing face;

a protective mask supports the face painting thereon, and until application;

wherein the protective mask has a shape that contours the existing face; and a transparent film;

wherein said transparent film and protective mask sandwich the face painting, and wherein said transparent film attaches to an edge of the protective mask and does not react with said face painting, and which is removed before application of the face painting to said existing face via placement of the protective mask against said existing face.

2. The face-painting system as described in claim 1 wherein the face painting is composed of a paint that adheres to the skin, is breathable, and is non-toxic.

3. The face-painting system as described in claim 1 wherein the face painting is composed of a mixture of paint and adhesive that easily adhere to a said existing face, is breathable, is non-toxic.

4. The face-painting system as described in claim 1 wherein the face painting resembles a sports-related decals, music band-related decals, comic-book hero faces, Halloween based faces, colors, pictures, camouflage, or crests.

5. The face-painting system as described in claim 1 wherein the face painting has openings to accommodate the nose, mouth, and eyes.

6. The face-painting system as described in claim 1 wherein the face painting is adapted for other areas of a body.

7. The face-painting system as described in claim 1 wherein the protective mask is made of a material that is non-reactive with the face painting.

8. The face-painting system as described in claim 1 wherein the transparent film is made of a material comprising a plastic, fabric, waxed paper; or paper.

* * * * *